US012521620B2

(12) United States Patent
Vandamia

(10) Patent No.: US 12,521,620 B2
(45) Date of Patent: Jan. 13, 2026

(54) FOOTBALL PLAYER'S HAND-COVERING

(71) Applicant: Christopher Vandamia, Washington, PA (US)

(72) Inventor: Christopher Vandamia, Washington, PA (US)

( * ) Notice: Subject to any disclaimer, the term of this patent is extended or adjusted under 35 U.S.C. 154(b) by 0 days.

(21) Appl. No.: 18/742,218

(22) Filed: Jun. 13, 2024

(65) Prior Publication Data

US 2025/0381467 A1 Dec. 18, 2025

(51) Int. Cl.

| | |
|---|---|
| ***A41D 19/01*** | (2006.01) |
| ***A41D 19/00*** | (2006.01) |
| ***A41D 19/015*** | (2006.01) |
| ***A63B 71/14*** | (2006.01) |

(52) U.S. Cl.

CPC ..... *A63B 71/141* (2013.01); *A41D 19/0006* (2013.01); *A41D 19/0068* (2013.01); *A41D 19/01582* (2013.01); *A41D 19/01588* (2013.01)

(58) Field of Classification Search

CPC ..... A63B 71/141; A41D 19/0006; A41D 19/0068; A41D 19/01582; A41D 19/01588

See application file for complete search history.

(56) References Cited

U.S. PATENT DOCUMENTS

| | | | | |
|---|---|---|---|---|
| 3,096,523 A | | 7/1963 | Bruchas | |
| 5,309,573 A | * | 5/1994 | Solar | A41D 19/01582 2/160 |
| 5,640,712 A | * | 6/1997 | Hansen | A63B 71/143 2/161.1 |
| 6,006,358 A | | 12/1999 | Keating | |
| 6,065,155 A | | 5/2000 | Sandusky | |
| 6,223,353 B1 | * | 5/2001 | Lardieri, Jr. | A41D 13/082 2/160 |
| 7,234,172 B1 | * | 6/2007 | Hoelscher | A41D 19/01582 2/163 |
| 7,293,296 B1 | * | 11/2007 | Beraznik | A63B 71/148 2/21 |
| 10,646,749 B1 | * | 5/2020 | Williams | A63B 23/16 |
| 10,994,189 B2 | * | 5/2021 | Fukae | A41D 19/01523 |
| 11,865,431 B1 | * | 1/2024 | Baker | A41D 19/01582 |
| 11,930,869 B2 | * | 3/2024 | Leone | A41D 19/001 |
| 2002/0129436 A1 | * | 9/2002 | Terris | A63B 69/3608 2/164 |
| 2003/0051285 A1 | * | 3/2003 | Bower | A63B 71/141 2/161.1 |
| 2003/0163862 A1 | * | 9/2003 | Hoffman | A63B 71/143 2/161.1 |
| 2003/0192104 A1 | * | 10/2003 | Wilder | A41D 19/01588 2/161.1 |
| 2004/0060097 A1 | * | 4/2004 | Bamber | A63B 63/007 2/161.4 |

(Continued)

*Primary Examiner* — Khaled Annis

(74) *Attorney, Agent, or Firm* — Boudwin Intellectual Property Law, LLC; Daniel Boudwin

(57) ABSTRACT

A football player's hand-covering that stop a player's fingers from grabbing a football or another player during play and solves the problem of being penalized in a football game for holding and/or pass interference. The football training gloves each include a base glove having a plurality of elongated finger and thumb compartments, a top surfacing, and a bottom surfacing and a planar mitt disposed on the bottom surfacing of the base glove. The football player's hand-covering is made of carbon black materials and is made via a 3D printing process.

12 Claims, 6 Drawing Sheets

(56) References Cited

U.S. PATENT DOCUMENTS

| | | | | |
|---|---|---|---|---|
| 2004/0088777 | A1* | 5/2004 | Hochmuth | A63B 71/148 2/163 |
| 2006/0185058 | A1 | 8/2006 | McGough | |
| 2007/0226866 | A1* | 10/2007 | Geyer | A63B 71/148 2/16 |
| 2008/0010719 | A1* | 1/2008 | Hoelscher | A41D 19/01588 2/161.1 |
| 2012/0028738 | A1* | 2/2012 | Love | A63B 71/141 473/438 |
| 2012/0131715 | A1* | 5/2012 | Copeland | A41D 19/01582 2/161.1 |
| 2013/0276207 | A1* | 10/2013 | Curl | A41D 19/01547 2/163 |
| 2015/0040289 | A1 | 2/2015 | Gaff et al. | |
| 2015/0119200 | A1* | 4/2015 | Jones | A63B 21/0607 482/44 |
| 2015/0366277 | A1* | 12/2015 | Rabbeth, Jr. | A63B 71/141 602/22 |
| 2016/0038822 | A1* | 2/2016 | Zinder | A63B 71/141 2/21 |
| 2016/0332817 | A1* | 11/2016 | Ahdoot | A63B 21/4019 |
| 2017/0208879 | A1* | 7/2017 | Kim | A41D 19/01523 |
| 2017/0314182 | A1* | 11/2017 | Hollis | D06F 59/04 |
| 2018/0099206 | A1* | 4/2018 | Staub | A63B 71/10 |
| 2019/0143189 | A1* | 5/2019 | Elmore | A63B 69/24 473/438 |
| 2020/0016474 | A1* | 1/2020 | Thompson | A63B 71/12 |
| 2020/0305526 | A1* | 10/2020 | Gantz | C08J 11/06 |
| 2022/0187918 | A1* | 6/2022 | Nieman | G06F 3/011 |
| 2023/0357547 | A1* | 11/2023 | Testud | C08L 71/00 |
| 2023/0371628 | A1* | 11/2023 | Villarreal | A63B 71/148 |

* cited by examiner

FOOTBALL PLAYER'S HAND-COVERING

BACKGROUND OF THE INVENTION

The present invention relates to a pair of training gloves. More specifically, the present invention relates to a football player's hand-covering that stop a player's fingers from grabbing a football or another player during play and solves the problem of being penalized in a football game for holding and pass interference.

Holding and pass interference penalties are more prominent penalties that more frequently are determining the outcome of close football games. It is becoming increasingly more important to train players not to commit these crucial penalties.

What is needed is a football player's hand-covering that stop a player's fingers from grabbing a football or another player during play and solves the problem of being penalized in a football game for holding and pass interference.

SUMMARY OF THE INVENTION

In view of the foregoing disadvantages inherent in the known types of football training gloves now present in the prior art, the present invention provides a football player's hand-covering, wherein the same may be utilized for providing convenience for the user when trying to prevent holding and pass interference penalties.

The present system comprises a base glove having a plurality of elongated finger and thumb compartments, a top surfacing, and a bottom surfacing and a planar mitt disposed on the bottom surfacing of the base glove, wherein the base glove is configured and placed over a hand of a player.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
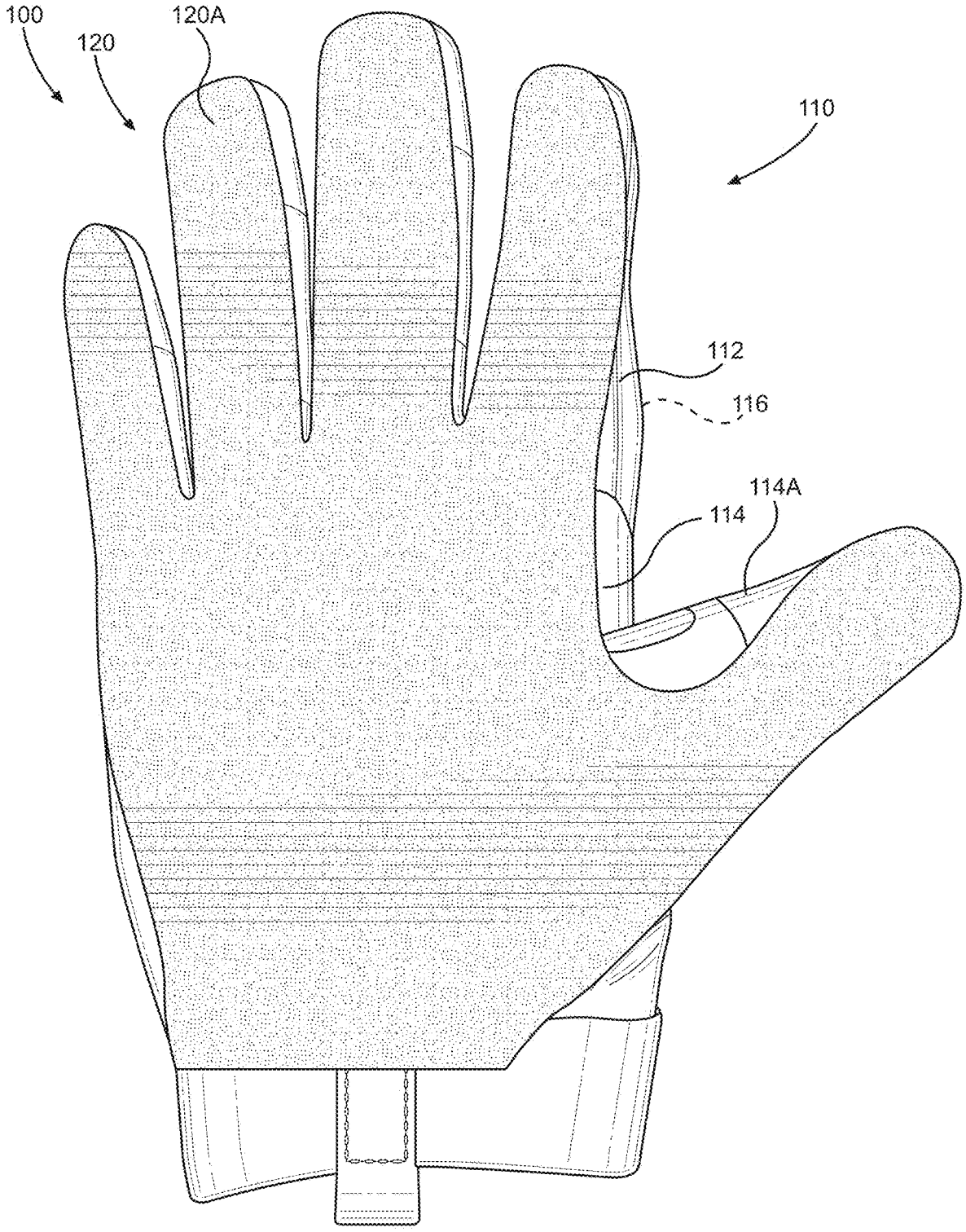
FIG. 1 shows an embodiment of an overhead perspective view of a football player's hand-covering.

Reference is made herein to the attached drawings. Like reference numerals are used throughout the drawings to depict like or similar elements of the football player's hand-covering. The figures are intended for representative purposes only and should not be considered to be limiting in any respect.

Referring now to FIG. 1, there is shown an embodiment of an overhead perspective view of a football player's hand-covering 100.

The football player's hand-covering 100 may include a base glove 110 and a planar mitt 120.

The base glove 110 may include a plurality of elongated finger and thumb compartments 112, a top surfacing 114, and a bottom surfacing 116.

The planar mitt 120 may be disposed on the bottom surfacing 116 of the base glove 100 and may be configured to stop a player's hand from bending around a football or another player. More specifically, the planar mitt 120 may prevent a player from being penalized in the football game for a holding and/or a pass interference penalty or the like.

Figure 2:
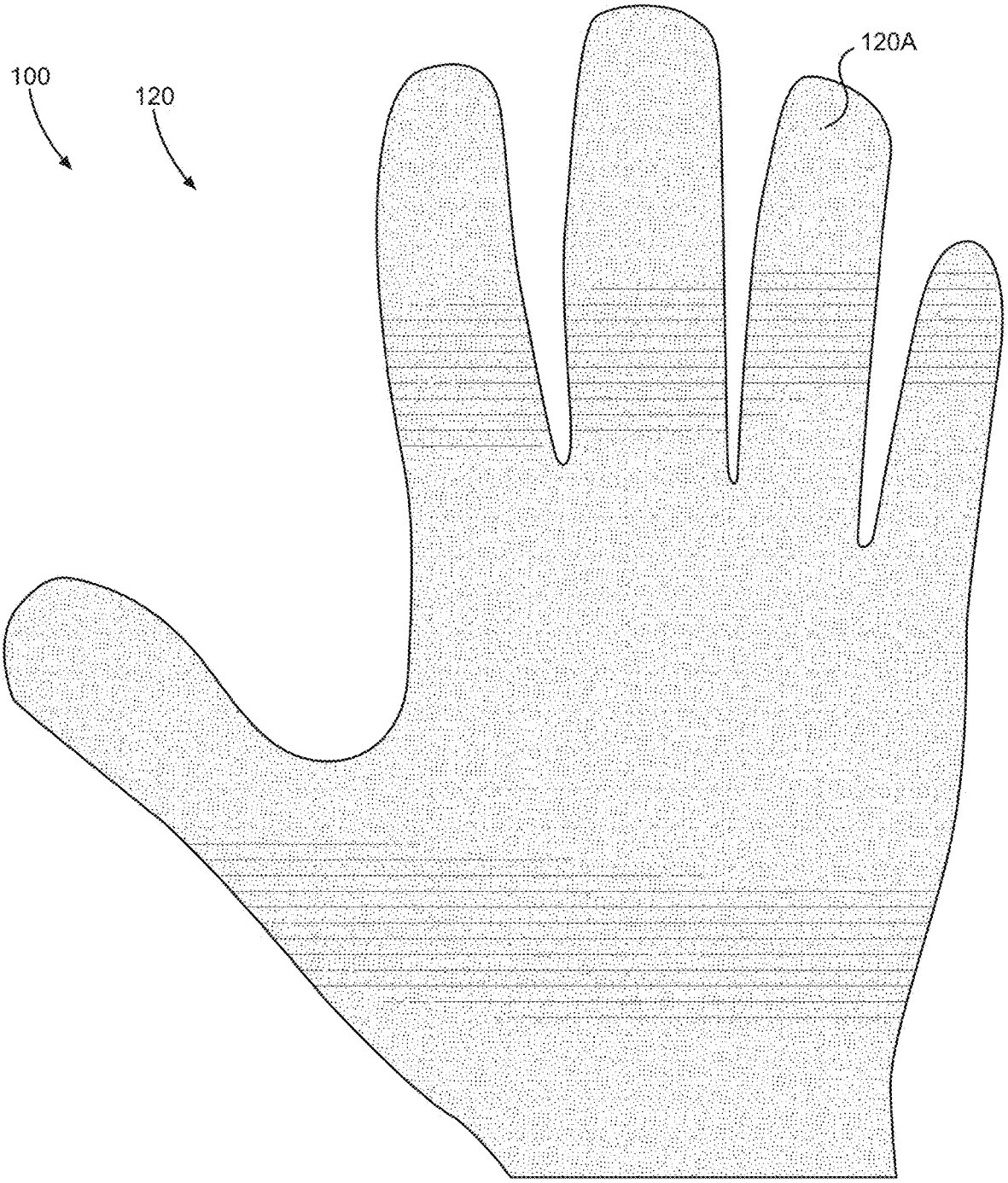
FIG. 2 shows an embodiment of an overhead perspective view of a planar mitt of the football player's hand-covering.

Referring now to FIG. 2, there is shown an embodiment of an overhead perspective view of a planar mitt 120 of the football player's hand-covering 100.

The planar mitt 120 may be made of a relatively lightweight hard material molded into a planar hand-shape 120A in a relatively relaxed position.

Figure 3:
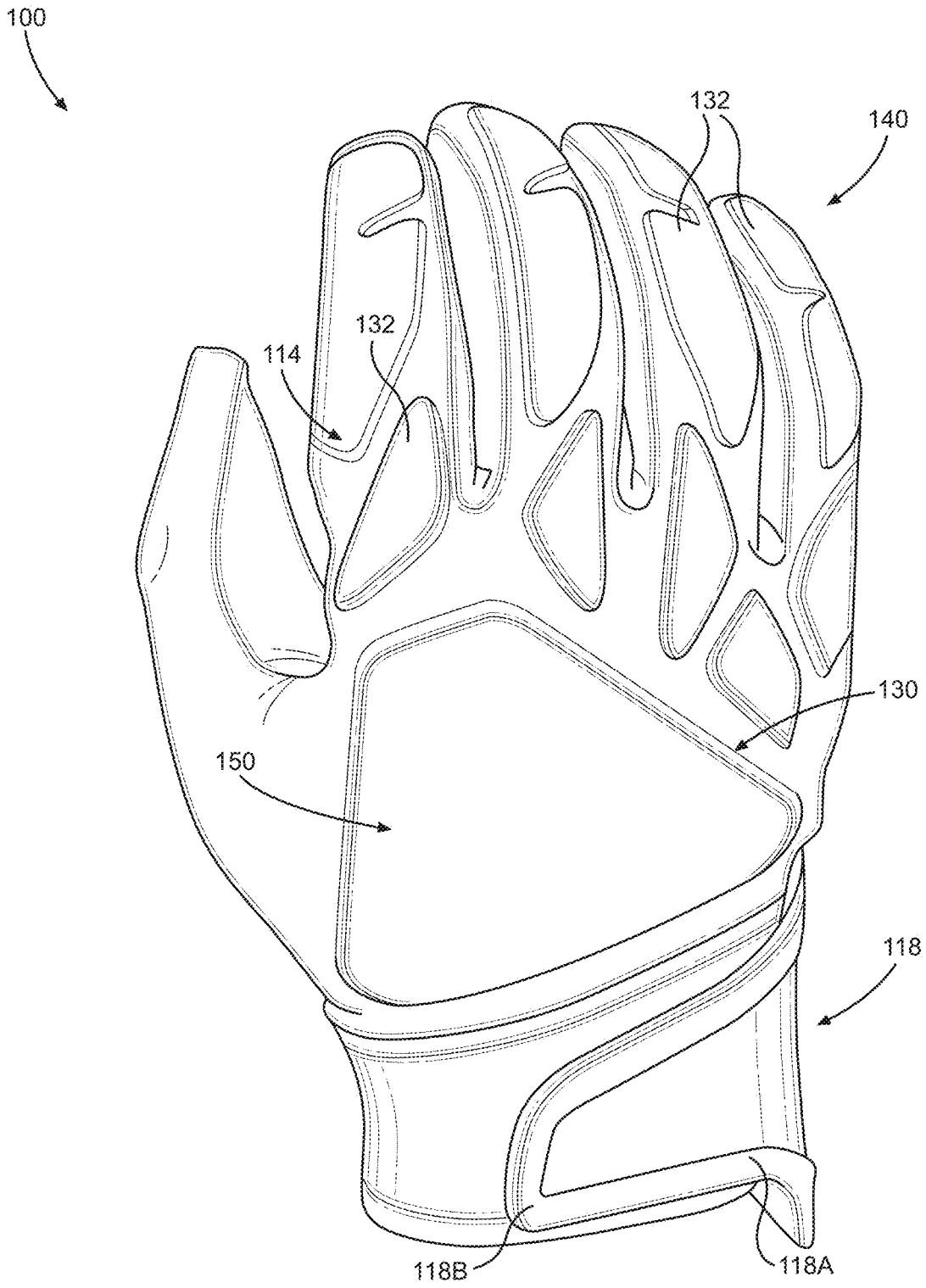
FIG. 3 shows an embodiment of an overhead perspective view of the football player's hand-covering.

Referring now to FIG. 3, there is shown an embodiment of an overhead perspective view of the football player's hand-covering 100. More specifically, the football player's hand-covering 100 shown in FIG. 3 is specifically for a receiver or the like that catches footballs during a football game.

The football player's hand-covering 100 may include a relatively lightweight planar piece 130, a plurality of holes 140, and an indica 150.

The relatively lightweight planar piece 130 may be sewn into the top surfacing 114 of each of the football player's hand-covering 100 that may be configured to stop a player's hand from bending around a football or another player, while providing support to the player's hand. There may also be additional relatively lightweight planar pieces 132 sewn into the top surfacing 114 over the player's knuckles and fingers for further support.

The holes 140 may be disposed on throughout the top surfacing 114 of each of the football player's hand-coverings 100 to provide ventilation to the player's hand.

The base glove 110 may optionally include a fastener 118 configured to secure the base glove 110 around a player's hand or the like. More specifically, the fastener 118 may include a strap 118A having a hook and loop fastener 118B to secure the base glove 110 around a player's hand or the like.

Figure 4:
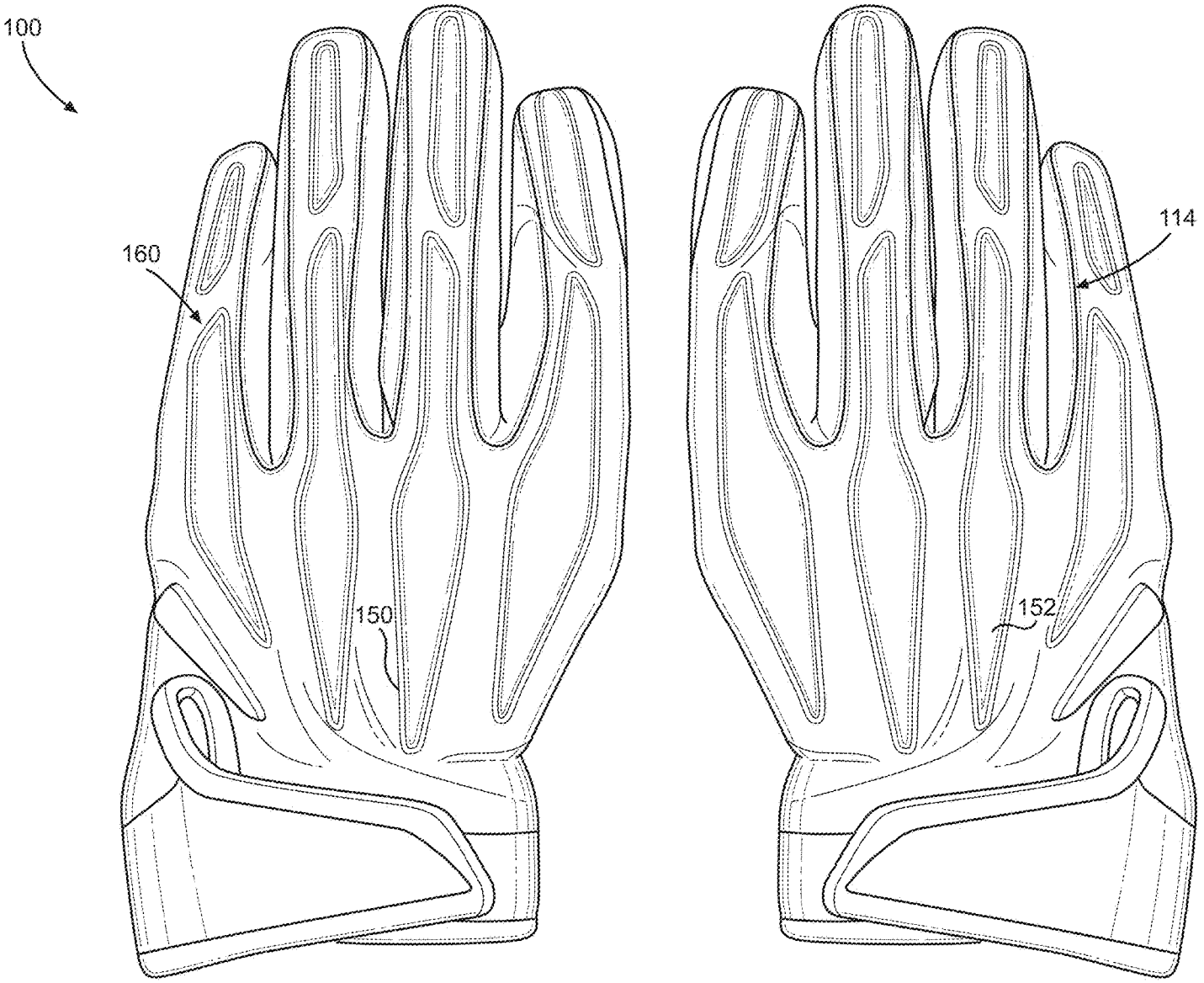
FIG. 4 shows an embodiment of an overhead perspective view of a pair of the football player's hand-covering.

Referring now to FIG. 4, there is shown an embodiment of an overhead perspective view of a pair of the football player's hand-covering 100. More specifically, the football player's hand-covering 100 shown in FIG. 4 is specifically for a receiver or the like that catches footballs during a football game or the like.

The indica 150 may be disposed anywhere on the top surfacing 114 of each of the football player's hand-coverings 100. The indica 150 may include one or more additional indica 152 as well.

The football player's hand-covering 100 may also include a plurality of padding 160. The padding 160 may be sewn into the top surfacing 114 over the player's knuckles and fingers for protection of the player's fingers and knuckles or the like.

The holes 140 may be disposed on the padding 160 of each of the football player's hand-coverings 100 to provide ventilation to the padding 160 or the like.

The football player's hand-covering 100 may come in any suitable styles or colors or the like.

Figure 5:
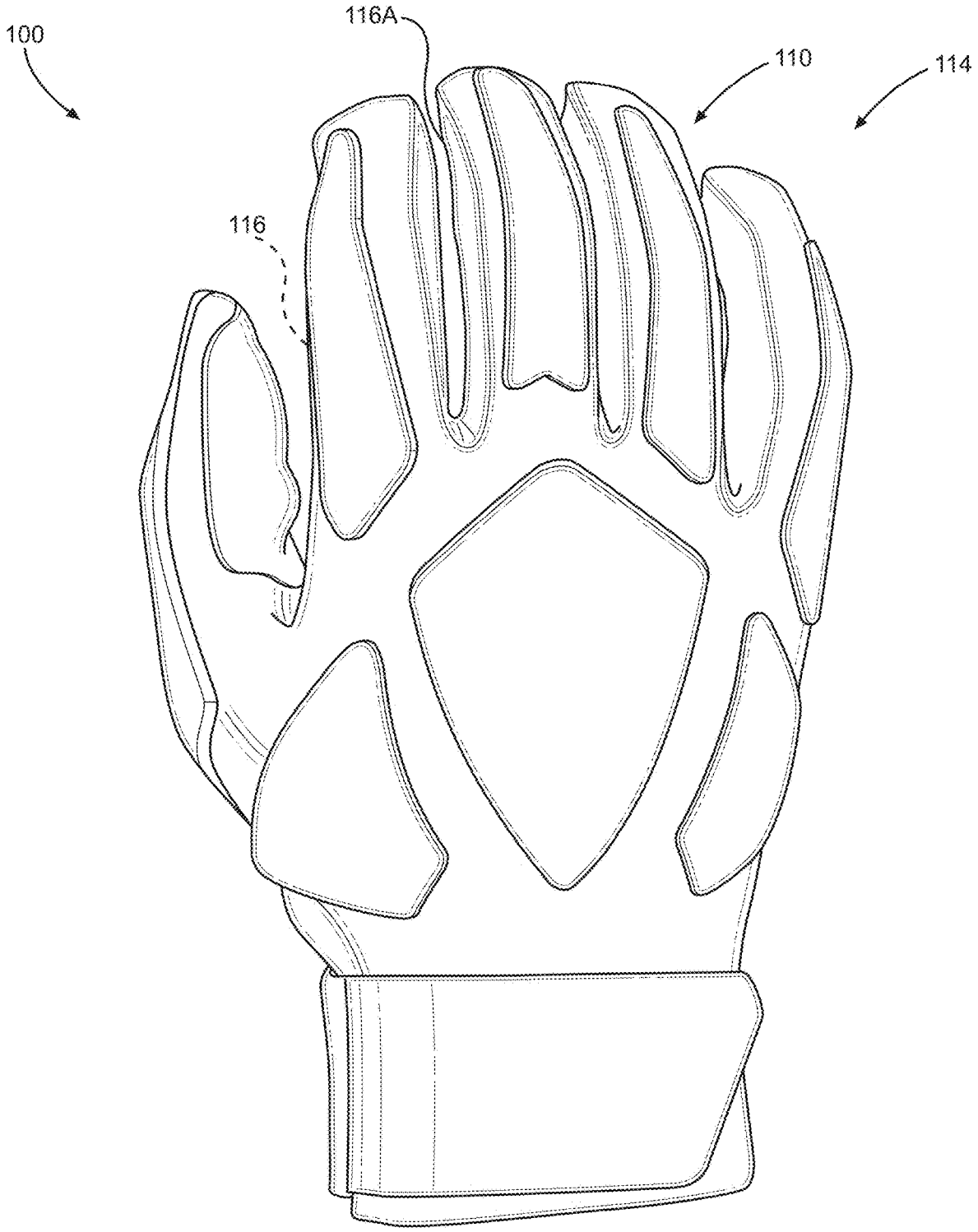
FIG. 5 shows an embodiment of an overhead perspective view of the football player's hand-covering.

Referring now to FIG. 5, there is shown an embodiment of an overhead perspective view of the football player's hand-covering 100. More specifically, the football player's hand-covering 100 shown in FIG. 5 is specifically for an adult football lineman during a football game.

The top surfacing 114 of the base glove 110 may be entirely covered in a plurality of padding 114A to protect a top portion of the player's hands.

The bottom surfacing 116 may be entirely covered in a plurality of raised padding 116A to protect a bottom portion of the player's hands.

Figure 6:
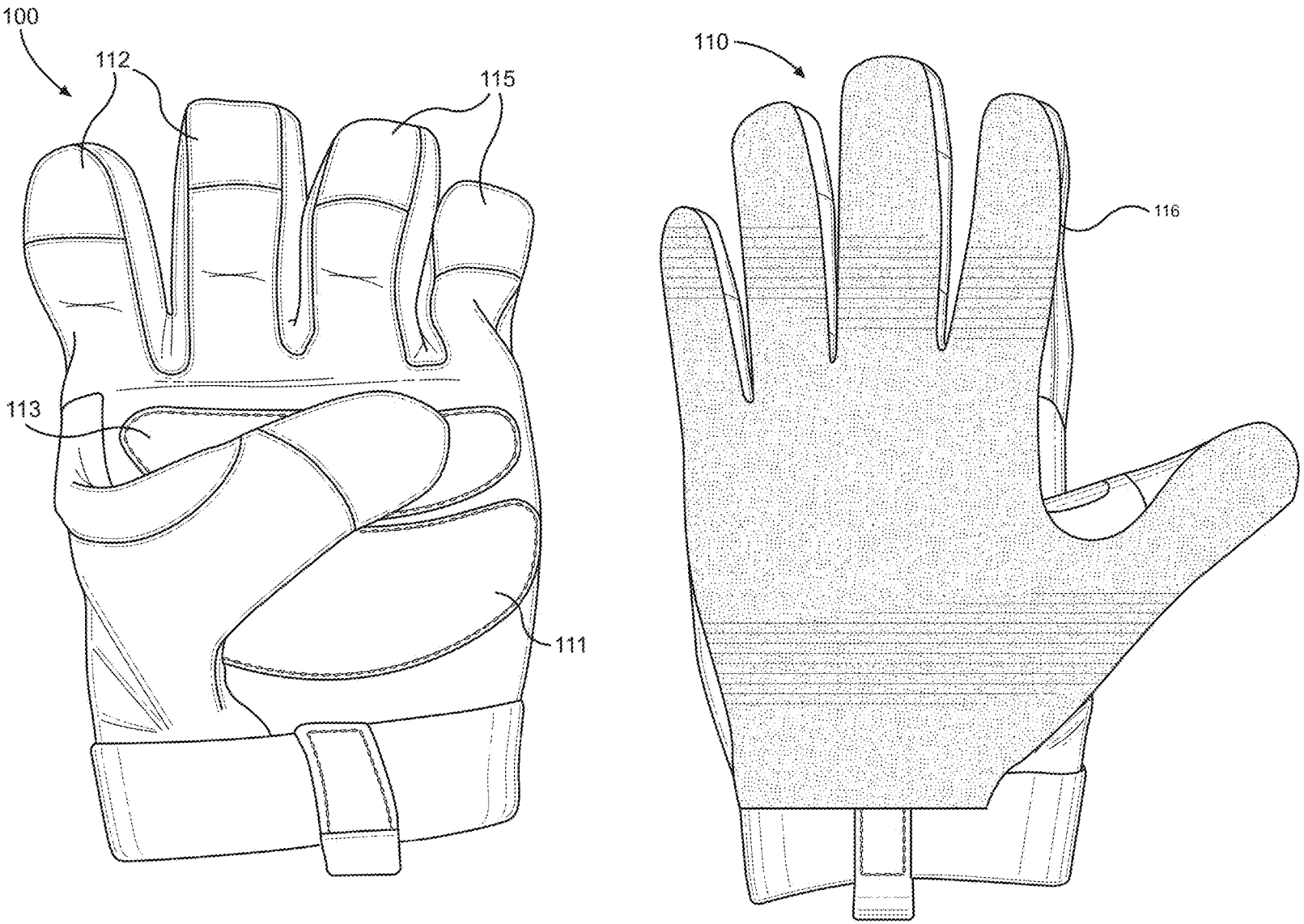
FIG. 6 shows an embodiment of a pair of overhead perspective views of the football player's hand-covering.

Referring now to FIG. 6, there is shown an embodiment of a pair of overhead perspective views of the football player's hand-covering 100.

The bottom surfacing 116 may include a first horizontal raised pad 111 to protect a bottom portion of the player's palms and a second horizontal raised pad 113 over the players hand calluses or the like. There may also be a plurality of pads 115 disposed over the fingertips and thumb of the player on an end of the elongated finger and thumb compartments (FIG. 1, 112) of the glove (FIG. 1, 110). The first horizontal raised pad 111, the second horizontal raised pad 113, and the pads 115 may be sewn into the bottom surfacing 116 and the elongated finger and thumb compartments 112 of the glove 110 or the like.

The football player's hand-covering 100 may be made of carbon black materials, relatively stronger plastics or composites or the like.

The football player's hand-covering 100 may be made via a 3D printing process or the like.

In other embodiments of the football player's hand-covering 100, the glove 110 may include all four fingers and a thumb, may include only one finger, may include only a palm, may include a bar across to a thumb, may have a suitable contour, may be flat, or may be bent in a shape of a relaxed hand.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A football player's hand-covering, comprising:

a base glove having a plurality of elongated finger and thumb compartments, a top surfacing, and a bottom surfacing; and a planar mitt disposed on the bottom surfacing of the base glove;

wherein the base glove is configured and placed over a hand of a football player;

wherein the planar mitt prevents the football player from being penalized in the football game for a holding and/or a pass interference penalty;

wherein the planar mitt is a planar handshape in a relaxed position;

wherein the top surfacing of the base glove includes a lightweight planar piece sewn into the top surfacing of the base glove adapted to stop the football player's hand from bending around a football or another football player, while providing support to the football player's hand; and wherein the top surfacing of the base glove includes a plurality of additional lightweight planar pieces sewn into the top surfacing of the base glove over the football player's knuckles and fingers for further support.

2. The football player's hand-covering of claim 1, further comprising a fastener that includes a strap having a hook and loop fastener to secure the base glove configured to secure the base glove around the football player's hand.

3. The football player's hand-covering of claim 1, further comprising a plurality of fingertips and thumb pads disposed over the fingertips and thumb of the football player on an end of the elongated finger and thumb compartments of the base glove.

4. The football player's hand-covering of claim 1, wherein the bottom surfacing includes a first horizontal raised pad to protect a bottom portion of a football player's palms and a second horizontal raised pad over a football player's hand calluses.

5. The football player's hand-covering of claim 4, wherein the first horizontal raised pad, the second horizontal raised pad, and the fingertips and thumb pads are sewn into the bottom surfacing and the elongated finger and thumb compartments of the glove.

6. The football player's hand-covering of claim 1, wherein the planar mitt is configured to stop the football player's hand from bending around the football or another football player.

7. The football player's hand-covering of claim 1, wherein the planar mitt is made of a lightweight hard material.

8. The football player's hand-covering of claim 1, further comprising a plurality of padding sewn into the top surfacing over a football player's knuckles and fingers for protection of the football player's knuckles and fingers.

9. The football player's hand-covering of claim 8, wherein the top surfacing of the base glove is entirely covered in the padding to protect a top portion of the football player's hands.

10. The football player's hand-covering of claim 1, wherein the football player's hand-covering is specifically for a receiver that catches the football during the football game.

11. The football player's hand-covering of claim 1, wherein the football player's hand-covering is specifically for an adult football lineman during the football game.

12. The football player's hand-covering of claim 1, wherein the football player's hand-covering is made of carbon black materials.

* * * * *